US008399766B2

(12) United States Patent
Hane et al.

(10) Patent No.: US 8,399,766 B2
(45) Date of Patent: Mar. 19, 2013

(54) CABLE CONNECTING MEMBER FOR USE IN COLD CLIMATES

(75) Inventors: Yoshinari Hane, Tokyo (JP); Kouzou Kurita, Tokyo (JP); Kenji Takahashi, Tokyo (JP); Takaaki Kubozono, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 493 days.

(21) Appl. No.: 12/622,772

(22) Filed: Nov. 20, 2009

(65) Prior Publication Data

US 2010/0216333 A1 Aug. 26, 2010

(30) Foreign Application Priority Data

Feb. 26, 2009 (JP) ..... 2009-043421

(51) Int. Cl.
*H01R 4/00* (2006.01)

(52) U.S. Cl. ..... 174/84 R

(58) Field of Classification Search ..... 174/73 R, 174/73 SC, 74 R, 84 R, 88 R
See application file for complete search history.

(56) References Cited

U.S. PATENT DOCUMENTS

| | | | | | |
|---|---|---|---|---|---|
| 3,816,639 | A * | 6/1974 | Anderson et al. | ..... | 174/73.1 |
| 3,932,933 | A * | 1/1976 | Broad | ..... | 29/859 |
| 4,110,550 | A * | 8/1978 | Di Pietro | ..... | 174/19 |
| 4,431,861 | A * | 2/1984 | Clabburn et al. | ..... | 174/73.1 |
| 4,551,915 | A * | 11/1985 | Larsson | ..... | 29/858 |
| 7,351,908 | B2 * | 4/2008 | Wentzel et al. | ..... | 174/36 |

* cited by examiner

*Primary Examiner* — William Mayo, III
(74) *Attorney, Agent, or Firm* — Oblon, Spivak, McClelland, Maier & Neustadt, L.L.P.

(57) ABSTRACT

A cable connecting member for use in cold climates includes a rubber insulating tube housing an end of a cable and enhancing electrical insulation from the cable. A rubber spacer is inserted between the rubber insulating tube and the end of the cable. At a temperature at which an elongation modulus of the rubber insulating tube increases three or more times as high as the elongation modulus of the rubber insulating tube at room temperature, an elongation modulus of the rubber spacer at such temperature is less than three times as high as the elongation modulus of the rubber spacer at room temperature.

7 Claims, 5 Drawing Sheets

CABLE CONNECTING MEMBER FOR USE IN COLD CLIMATES

BACKGROUND OF THE INVENTION

1. Field of the Invention

The present invention relates to a cable connecting member which is directly connected to an apparatus and connects a power cable, such as a CV cable or an EP rubber insulating/EP rubber sheathed cable, and an electric power apparatus, such as a transformer or a switch, and to a cable connecting member used for connecting power cables, and, more particularly, the present invention relates to a cable connecting member for use in cold climates which is used at an environmental temperature including a low-temperature range, such as from 80° C. down to −40° C., preferably from 80° C. down to −60° C.

2. Description of the Related Art

Conventionally, a cable connecting member shown in FIG. 8, for example, is used in connecting a power cable and an electric power apparatus or connecting power cables.

FIG. 8 is a sectional view schematically showing the configuration of a conventional cable connecting member which is directly connected to an apparatus and is T-shaped (hereinafter a "directly-connected (T-shaped) cable connecting member").

In FIG. 8, a directly-connected cable connecting member 800 has a rubber insulating tube 801 housing an end of a cable 850 and enhancing electrical insulation from the cable and a rubber spacer 803 inserted into an inner semiconducting layer 802 provided in the rubber insulating tube 801. Moreover, at a cable insertion-side end of the rubber spacer 803, an outer semiconducting layer 804 for alleviating electric field concentration is formed. The rubber spacer 803 is used as an adapter for compensating for a fit diameter difference when the inside diameter of the inner semiconducting layer 802 is larger than the outside diameter of an insulation layer 851 of the cable 850 used, or to make it possible to apply a common rubber insulating tube to several types of cables having different outside diameters. The rubber insulating tube 801, the inner semiconducting layer 802, and the rubber spacer 803 are formed of ethylene propylene rubber (hereinafter referred to simply as "EP rubber"), or the rubber insulating tube 801, the inner semiconducting layer 802, and the rubber spacer 803 are formed of silicone rubber. Incidentally, in FIG. 8, an outer semiconducting layer and a metal shielding layer of the cable, connection by a semiconducting fusion rubber tape or the like which electrically connects an outer semiconducting layer in the rubber spacer and the outer semiconducting layer of the cable, leading out of a grounding conductor, and the like, are not shown, and the description thereof will be omitted.

In the directly-connected cable connecting member configured as described above, when the rubber spacer 803 is fitted over an end of the insulation layer 851 of the cable 850 and the rubber spacer 803 is inserted into the rubber insulating tube 801 in which the inner semiconducting layer 802 is provided, the interface between the rubber spacer 803 and the rubber insulating tube 801 is held at a predetermined contact pressure by the rubber elasticity of the rubber insulating tube 801, whereby insulating characteristics are ensured. Likewise, insulating characteristics are ensured also at the interface between the insulation layer 851 of the cable 850 and the rubber spacer 803.

Here, in cold climates, the temperature of an environment in which a cable connecting member is placed sometimes decreases from room temperature to −30° C. or lower. In this case, the elongation modulus of EP rubber exhibits temperature dependence shown in FIG. 2, and shows a tendency to increase sharply at −30° C. or lower. Since the EP rubber tends to become hard with increasing elongation modulus of elasticity, the contact pressure at the interface with the rubber spacer decreases. When a current passing through the cable is small and a rise in the temperature of a conductor is small, the temperature of the cable connecting member decreases as follows. The temperature of the rubber insulating tube exposed to an external environment first decreases, and the temperatures of the rubber spacer, the insulation layer of the cable, the conductor, and the like, which are placed inside the rubber insulating tube eventually decrease with decreasing temperature of the rubber insulating tube. For example, when the EP rubber is almost completely hardened as a result of the temperature of the rubber insulating tube having decreased to −50° C. and the elongation modulus of the EP rubber having increased to a level which is three or more times as high as that at room temperature, the temperature inside the rubber spacer does not decrease with decreasing temperature of the rubber insulating tube and is sometimes higher than the temperature of the rubber insulating tube. At this time, as time passes, the temperature inside the rubber spacer also decreases to a temperature that is equal to that of the rubber insulating tube, and the EP rubber of the rubber spacer is also hardened almost completely. However, since the EP rubber of the rubber insulating tube is hardened and, while keeping the shape thereof, the temperature inside the rubber spacer further decreases, the outside diameter of the rubber spacer becomes smaller than the inside diameter of the rubber insulating tube observed when the rubber insulating tube was hardened, whereby a gap is formed at the interface between the rubber insulating tube and the rubber spacer. When this gap grows to several tens of micrometers or more, partial discharge occurs in this gap, which may produce a dielectric breakdown at a working voltage due to discharge degradation of the interface. Moreover, a gap is also formed at the interface between the rubber spacer and the insulation layer of the cable, which may produce a dielectric breakdown also at the interface between the rubber spacer and the insulation layer of the cable.

To solve this problem, a cable connecting member shown in FIG. 9 have been used. Another conventional directly-connected (T-shaped) cable connecting member is shown in FIG. 9. In FIG. 9, a cable connecting member 900 includes an insulating layer 901 formed of cross-linked silicone rubber, an inner semiconducting layer 902 formed of cross-linked silicone rubber, and an outer semiconducting layer 903 formed of cross-linked EP rubber. In this cable connecting member, a power cable terminal obtained by attaching a terminal to a conductor of a power cable is inserted into a cable terminal holder 904, and an apparatus terminal obtained by attaching a bushing to a conductor of an apparatus is inserted into an apparatus terminal holder 905. In this way, the power cable terminal and the conductor of the apparatus are mechanically connected (Japanese Laid-Open Patent Publication (Kokai) No. 2003-348744).

Even when the environmental temperature is −50° C., the silicone rubber does not show a tendency to become hard because an increase in its elongation modulus from that at room temperature to that at −50° C. is small (see FIG. 2), and has rubber elasticity which is equal to that at room temperature. Thus, a gap is not formed at the interface between the cable terminal holder 904 and a cable insulator until after the temperature inside the insulating layer 901 has decreased with decreasing temperature of the outer semiconducting layer 903, and a dielectric breakdown does not occur.

However, the problem of the technique proposed by Japanese Laid-Open Patent Publication (Kokai) No. 2003-348744 is that, since the insulating layer is formed in almost the entire region inside the outer semiconducting layer, and the mechanical strength of the silicone rubber is lower than that of the EP rubber, the insulating layer is susceptible to mechanical damage and is likely to cause a decrease in insulating performance. Moreover, the silicone rubber has high water absorption, causing a problem of a decrease in insulating performance in humid conditions such as when it is snowing or raining. Furthermore, since the outer semiconducting layer delimiting an insertion opening of the cable terminal holder is formed of EP rubber, it is difficult to apply a common rubber insulating tube to several types of cables having different outside diameters.

SUMMARY OF THE INVENTION

The present invention provides a cable connecting member for use in cold climates which is capable of easily applying a common rubber insulating tube to several types of cables having different outside diameters and achieving high insulating performance without decreasing mechanical strength even in cold climates where the environmental temperature is low.

In a first aspect of the present invention, there is provided a cable connecting member for use in cold climates, comprising a rubber insulating tube housing an end of a cable and enhancing electrical insulation from the cable and a rubber spacer inserted between the rubber insulating tube and the end of the cable, and at a temperature at which the elongation modulus of the rubber insulating tube increases three or more times as high as the elongation modulus of the rubber insulating tube at room temperature, the elongation modulus of the rubber spacer at such temperature is less than three times as high as the elongation modulus of the rubber spacer at room temperature.

In a second aspect of the present invention, there is provided a cable connecting member for use in cold climates, comprising a rubber insulating tube housing an end of a cable and enhancing electrical insulation from the cable, a rubber spacer inserted between the rubber insulating tube and the end of the cable, a vulcanized rubber layer formed on a spacer housing-side surface of the rubber insulating tube, and a protective layer formed on the vulcanized rubber layer, and at a temperature at which the elongation modulus of the rubber insulating tube increases three or more times as high as the elongation modulus of the rubber insulating tube at room temperature, the elongation modulus of the vulcanized rubber layer at such temperature is less than three times as high as the elongation modulus of the vulcanized rubber layer at room temperature.

Moreover, it is preferable that the rubber insulating tube is formed of a composition containing ethylene propylene rubber as a main ingredient, and the rubber spacer is formed of a composition containing silicone rubber as a main ingredient.

Furthermore, it is preferable that the rubber insulating tube is formed of a rubber composition which is an ethylene propylene copolymer or a terpolymer containing a third component.

In addition, it is preferable that the rubber spacer have an outer peripheral surface making contact with an inner peripheral surface of a spacer holder provided in the rubber insulating tube, the spacer holder into which the rubber spacer is inserted, and the outside diameter of the rubber spacer is equal to or greater than the inside diameter of the spacer holder into which the rubber spacer is inserted.

Moreover, it is preferable that the rubber insulating tube have an inner semiconducting layer formed on an inner peripheral surface of a spacer holder into which the rubber spacer is housed, and the inner semiconducting layer make contact with an outer peripheral surface of the rubber spacer.

Furthermore, it is preferable that the rubber spacer have an innermost surface making contact with an end face of an insulation layer of the cable, and the innermost surface has a hole for a conductor, through which the conductor of the cable is inserted.

In addition, it is preferable that the cable connecting member for use in cold climates is a connecting member which is directly connected to an apparatus, the connecting member for connecting an end of a cable to the apparatus.

Moreover, it is preferable that the cable connecting member for use in cold climates is a straight connecting member for connecting ends of cables together.

According to the first aspect of the present invention, since the rubber spacer is inserted between the rubber insulating tube and an end of the cable, it is possible to compensate for a diameter difference between the rubber insulating tube and the cable easily even when cables having different outside diameters are used. Moreover, at a temperature at which the elongation modulus of the rubber insulating tube increases three or more times as high as the elongation modulus of the rubber insulating tube at room temperature, the elongation modulus of the rubber spacer at such temperature is less than three times as high as the elongation modulus of the rubber spacer at room temperature. This prevents a gap from being formed between the rubber spacer and the rubber insulating tube even under a low-temperature environment in which the elongation modulus of the rubber insulating tube increases sharply, and thereby prevents the occurrence of a dielectric breakdown. As a result, it is possible to apply a common rubber insulating tube easily to several types of cables having different outside diameters, and maintain high insulating performance without decreasing mechanical strength even in cold climates where the environmental temperature is low. Furthermore, it is possible to maintain high insulating performance with an inexpensive and simple structure because all that is needed is to fabricate a new rubber spacer.

According to the second aspect of the present invention, since the vulcanized rubber layer provides a high mechanical protective function even at low temperature, together with the low-temperature flexibility of the silicone rubber spacer, it is possible to maintain high low-temperature electrical characteristics of the cable connecting member.

Moreover, since silicone rubber has low mechanical strength compared with ethylene propylene rubber, it is possible to protect the silicone rubber effectively and provide improved prevention of water absorption.

Since the rubber insulating tube is formed of a rubber composition which is an ethylene propylene copolymer or a terpolymer containing a third component, it is possible to obtain the above-described effects more reliably.

Since the rubber spacer has an outer peripheral surface making contact with an inner peripheral surface of a spacer holder provided in the rubber insulating tube, the spacer holder into which the rubber spacer is inserted, and the outside diameter of the rubber spacer is equal to or greater than the inside diameter of the spacer holder into which the rubber spacer is inserted, a gap is not formed between the rubber spacer and the rubber insulating tube even under a low-temperature environment. This makes it possible to achieve high insulating performance reliably.

Furthermore, since the rubber insulating tube has an inner semiconducting layer formed on an inner peripheral surface of a spacer holder into which the rubber spacer is housed, and the inner semiconducting layer makes contact with an outer peripheral surface of the rubber spacer, a gap is not formed between the rubber spacer and the inner semiconducting layer even under a low-temperature environment. This makes it possible to achieve high insulating performance reliably.

In addition, since the rubber spacer has an innermost surface making contact with an end face of an insulation layer of the cable, and the innermost surface has a hole for a conductor, through which a conductor of the cable is inserted, it is possible to fix the cable securely to the rubber insulating tube and fix the conductor securely to a terminal placed outside the rubber spacer.

Further features and advantages of the present invention will become apparent from the following detailed description of exemplary embodiments with reference to the attached drawings.

DETAILED DESCRIPTION OF THE EMBODIMENTS

The present inventors carried out assiduous studies to attain the above object, and as a result discovered that if, at a temperature at which the elongation modulus of a rubber insulating tube increases three or more times as high as the elongation modulus of the rubber insulating tube at room temperature, the elongation modulus of a rubber spacer at such temperature is less than three times as high as the elongation modulus of the rubber spacer at room temperature, it is possible to apply a common rubber insulating tube easily to several types of cables having different outside diameters and achieve high insulating performance without decreasing mechanical strength even in cold climates where the environmental temperature is low, and it is possible to maintain high insulating performance with an inexpensive and simple structure because all that is needed is to fabricate a new rubber spacer.

The present invention was accomplished based on the above findings.

The present invention will now be described in detail with reference to the drawings showing preferred embodiments thereof.

Figure 1:
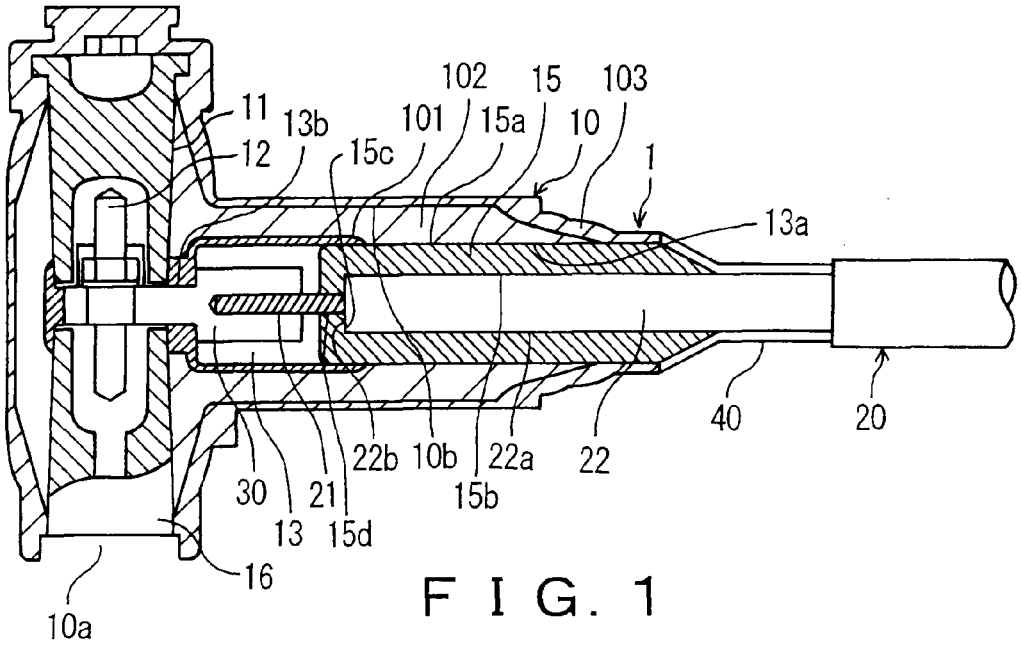
FIG. 1 is a sectional view schematically showing a configuration of a cable connecting member for use in cold climates according to an embodiment of the present invention.

FIG. 1 is a sectional view schematically showing the configuration of a cable connecting member for use in cold climates according to an embodiment of the present invention. Incidentally, this embodiment will be explained, taking up a cable connecting member which is directly connected to an apparatus and is T-shaped (hereinafter a "directly-connected (T-shaped) cable connecting member") as an example.

In FIG. 1, a cable connecting member 1 for use in cold climates is comprised of a substantially T-shaped rubber insulating tube 10 housing an end of a cable 20 and enhancing electrical insulation from the cable, a tapered insulating plug 11 provided in the rubber insulating tube 10, a stud bolt 12 which is disposed in the insulating plug 11 coaxially with the insulating plug and is electrically connected to a conductor 21 of the cable 20 via a compression terminal 30, and a rubber spacer 15 inserted between an end of the rubber insulating tube 10 and an end of the cable 20. In the vicinity of an end of the rubber spacer 15 protruding from the rubber insulating tube 10, an unillustrated semiconducting layer is formed. Moreover, an insulating tape 40 is wrapped around a part where the rubber spacer 15 is exposed to the outside, in such a way as to cover the semiconducting layer described above. Incidentally, in FIG. 1, an outer semiconducting layer and a metal shielding layer of the cable, connection by a semiconducting fusion rubber tape or the like which electrically connects an outer semiconducting layer in the rubber spacer and the outer semiconducting layer of the cable, leading out of a grounding conductor, and the like, are not shown, and their explanations are omitted.

The rubber insulating tube 10 has, at an end thereof along the axial direction of the insulating plug 11, a hole 10*a* for an apparatus, the hole 10*a* to which an apparatus is connected, and a bushing 16 provided around an outer peripheral portion of the hole 10*a* for an apparatus. The rubber insulating tube 10 is formed of a rubber composition containing ethylene propylene rubber (hereinafter referred to simply as "EP rubber") as a main ingredient, preferably a rubber composition which is an ethylene propylene copolymer or a terpolymer containing a third component. The outside diameter of the rubber insulating tube 10 on the side where the spacer is housed is, for example, $\phi 90$. The bushing 16 is formed of a composition containing epoxy resin, for example, as a main ingredient. When the rubber insulating tube 10 is secured to an apparatus, the rubber insulating tube 10 is insulated from a casing of the apparatus by the bushing 16, and a connecting terminal of the apparatus is electrically connected to the stud bolt 12.

Inside the rubber insulating tube 10, a spacer holder 13 into which the rubber spacer 15 is inserted is provided so as to be almost perpendicular to the axial direction of the insulating plug 11. Moreover, the rubber insulating tube 10 has an inner semiconducting layer 101 formed on an inner peripheral surface of the spacer holder 13, an insulating layer 102 which is disposed in a manner covering an outer peripheral surface of the inner semiconducting layer 101 and an outer peripheral surface of the rubber spacer 15 and provides electrical insulation between the inner semiconducting layer 101 and the rubber spacer 15, and an outer semiconducting layer 103 provided on an outer peripheral surface of the insulating layer 102 and forming a frame body of the rubber insulating tube 10. The inner semiconducting layer 101, the insulating layer 102, and the outer semiconducting layer 103 are formed integrally, and together form the rubber insulating tube 10.

For example, the inner semiconducting layer 101, the insulating layer 102, and the outer semiconducting layer 103 are molded of rubber.

In the spacer holder 13 of the rubber insulating tube 10, an inner peripheral surface 13*a* making contact with an outer peripheral surface 15*a* of the rubber spacer 15, which will be described later, is formed. When the cable 20 to which the rubber spacer 15 is attached is inserted into the rubber insulating tube 10, the outer peripheral surface 15*a* of the rubber spacer 15 is brought into contact with the inner peripheral surface 13*a* of the rubber insulating tube 10 by pressure by the rubber elasticity of any one of the rubber insulating tube 10 and the rubber spacer 15 or both, and the rubber spacer 15 is housed in the rubber insulating tube 10. At this time, the interface between the rubber insulating tube 10 and the rubber spacer 15 is held at a predetermined contact pressure by the rubber elasticity of any one of the rubber spacer 15 and the rubber insulating tube 10 or both, whereby insulating characteristics are ensured.

At the back of the inner semiconducting layer 101, a hole 13*b* into which the compression terminal 30 is inserted is provided. The inner semiconducting layer 101 is formed of a rubber composition containing EP rubber as a main ingredient, preferably a rubber composition containing, as a main ingredient, an ethylene propylene copolymer or a terpolymer containing a third component.

The rubber spacer 15 is a member having a virtually tube shape, and has the outer peripheral surface 15*a* making contact with the inner peripheral surface 13*a* of the spacer holder 13 and an inner peripheral surface 15*b* making contact with an outer peripheral surface 22*a* of an insulation layer 22 of the cable 20. The outside diameter of the rubber spacer 15 is designed so as to be equal to or greater than the inside diameter of the inner peripheral surface 13*a* of the spacer holder 13. Moreover, the inside diameter of the rubber spacer 15 is designed so as to be equal to or smaller than the outside diameter of the outer peripheral surface 22*a* of the insulation layer 22. The rubber spacer 15 is formed of a rubber composition containing silicone rubber, for example, as a main ingredient.

Furthermore, the rubber spacer 15 has an innermost surface 15*c* making contact with an end face 22*b* of the insulation layer 22 of the cable 20, and the innermost surface 15*c* has formed therein a hole 15*d* for a conductor, the hole 15*d* through which the conductor 21 of the cable 20 is inserted. This makes it possible to fix the cable 20 securely to the inner semiconducting layer 101 and fix the conductor 21 securely to the compression terminal 30.

When the rubber spacer 15 is attached to the cable 20, the inner peripheral surface 15*b* of the rubber spacer 15 makes contact with the outer peripheral surface 22*a* of the insulation layer 22, or the inner peripheral surface 15*b* of the rubber spacer 15 is brought into contact with the outer peripheral surface 22*a* of the insulation layer 22 by pressure by the rubber elasticity of the rubber spacer 15, whereby the rubber spacer 15 is fitted over the cable 20. At this time, the interface between the rubber spacer 15 and the insulation layer 22 is held at a predetermined contact pressure by the rubber elasticity of any one of the rubber spacer 15 and the insulation layer 22 or both, whereby insulating characteristics are ensured.

In this cable connecting member 1 for use in cold climates, the cable 20 is inserted into the rubber insulating tube 10 with the compression terminal 30 attached to the conductor 21 of the cable 20, and the compression terminal 30 is inserted into the hole 13*b*. Then, the connecting terminal of the apparatus is inserted into the hole 10*a* for an apparatus, the hole 10*a* of the cable connecting member 1. As a result, the conductor 21 of the cable 20 is electrically connected to the connecting terminal of the apparatus via the compression terminal 30.

Here, when a rubber insulating tube is connected to an apparatus via a bushing (or via an epoxy resin insulating member into which an EP rubber insulating member is inserted), it is important to clarify the behavior of the interface between EP rubber and epoxy resin and the behavior of the interface between EP rubber and silicone rubber under a low-temperature environment in evaluating insulating performance.

<Regarding the Interface Between EP Rubber and Epoxy Resin>

Since epoxy resin has a high elongation modulus (tensile modulus of elasticity) and high stiffness, a contact pressure at the interface between EP rubber and epoxy resin at room temperature is heavily dependent on the elasticity of EP rubber. However, when the environmental temperature decreases to a low-temperature range such as −30° C. or lower, the elongation modulus of EP rubber increases three or more times as high as that at room temperature, leading to a loss of the elasticity of EP rubber.

The coefficient of linear expansion of epoxy resin is, in general, 3.0 to $4.0\times10^{-5}$/K at a glass transition temperature or lower, and this remains largely unchanged in a low-temperature range. On the other hand, the coefficient of linear expansion of EP rubber is $4.1\times10^{-4}$/K at room temperature, $2.51\times10^{-4}$/K at −30° C., $2.07^{-4}$/K at −40° C., and $1.40\times10^{-4}$/K at −50° C. That is, although the coefficient of linear expansion of EP rubber shows a downward tendency during a decrease in temperature from room temperature to a low-temperature range of −30° C. or lower, it is always one digit greater than the coefficient of linear expansion of epoxy resin until the temperature has decreased to the low-temperature range. Therefore, in a structure in which an EP rubber member clamps an epoxy resin member from the outside, a gap is not formed at the interface between EP rubber and epoxy resin by temperature shrinkage.

Moreover, although the low-temperature compression set of EP rubber at −50 to −30° C. is 60% after the elapse of one hour from the release, since a gap is not formed at the interface between EP rubber and epoxy resin by temperature shrinkage, the insulating performance at the interface between EP rubber and epoxy resin is maintained.

Thus, in a structure in which an EP rubber member clamps an epoxy resin member from the outside, there is no decrease in insulating performance resulting from a decrease in environmental temperature, and there is little need to take the behavior of the interface between EP rubber and epoxy resin into consideration.

<Regarding the Interface Between EP Rubber and EP Rubber>

Since the cable connecting member cools down from the outside, a temperature difference develops between the outer rubber insulating tube and the inner rubber spacer, resulting in pressure fluctuations at the interface between a rubber insulating tube and a rubber spacer.

Until the overall temperature of the cable connecting member becomes equal to the environmental temperature, the temperature of the rubber spacer is higher than that of the rubber insulating tube, and the elongation modulus of the rubber spacer is lower than that of the rubber insulating tube. Therefore, the rubber elasticity of the rubber spacer is higher than the rubber elasticity of the rubber insulating tube.

This makes it impossible to compensate for pressure fluctuations at the interface between the rubber insulating tube and the rubber spacer caused by a change in environmental temperature with the rubber elasticity of the rubber spacer having high elasticity. As a result, the fluctuations remain as a compression set.

Figure 2:
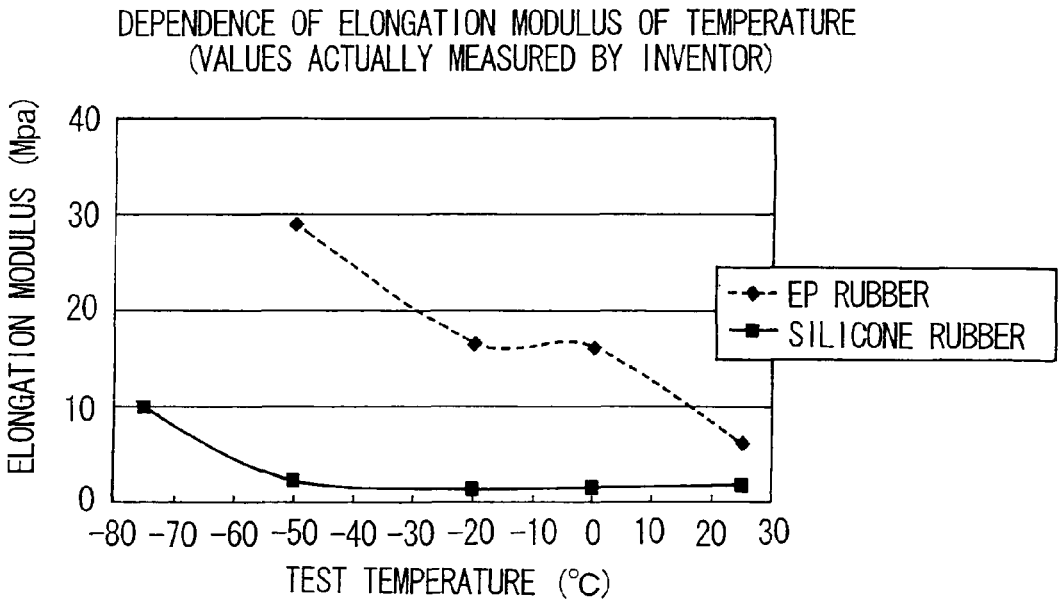
FIG. 2 is a graph for explaining a relationship between a test temperature and the elongation modulus of EP rubber or silicone rubber.
Figure 3:
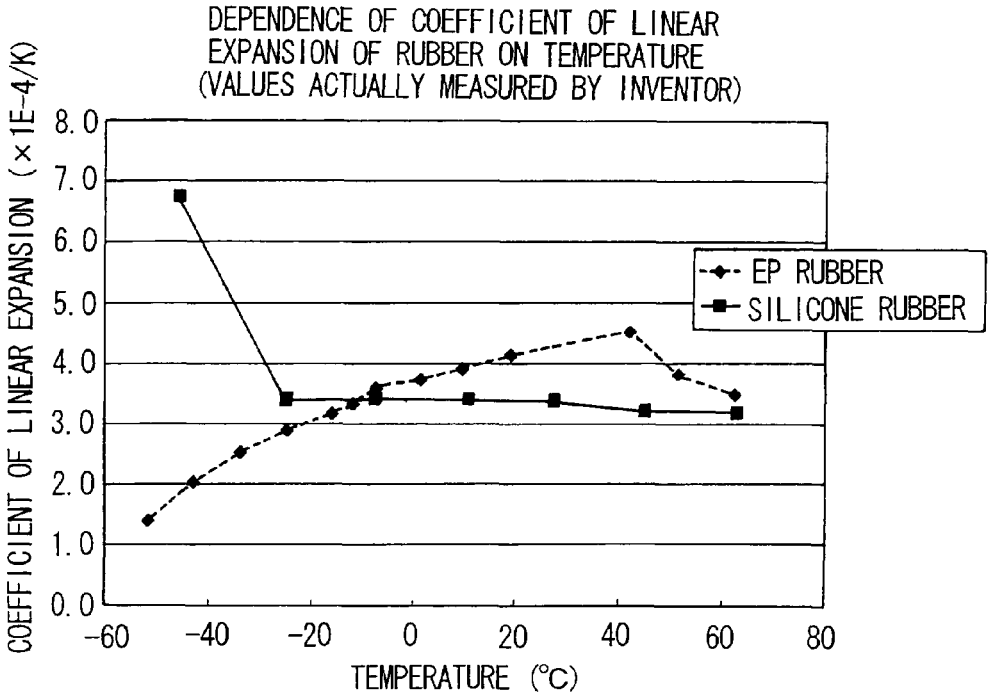
FIG. 3 is a graph for explaining a relationship between a test temperature and the coefficient of linear expansion of EP rubber or silicone rubber.

In a temperature range from room temperature down to −20° C., the elongation modulus of EP rubber is three or less times as high as that at room temperature, and the EP rubber still has rubber elasticity. However, when the temperature becomes equal to or lower than −20° C., the elongation modulus EP rubber shows a tendency to increase sharply, and reaches three or more times as high as that at room temperature, resulting in a loss of rubber elasticity (FIG. 2). Moreover, the coefficient of linear expansion of EP rubber is $4.1\times10^{-4}$/K at room temperature, $2.51\times10^{-4}$/K at −30° C., $2.07\times10^{-4}$/K at −40° C., and $1.40\times10^{-4}$/K at −50° C. (FIG. 3), showing a downward tendency from a value at room temperature down to a low-temperature range.

When the environmental temperature decreases from −30° C. to about −50° C., the outer rubber insulating tube is hardened while being fitted over the rubber spacer, and enters a constraint state in which the dimensions thereof do not vary. At this time, the temperature of the rubber spacer is higher than that of the rubber insulating tube, and the coefficient of linear expansion of the rubber spacer is higher than that of the rubber insulating tube. Therefore, when the rubber insulating tube has lost rubber elasticity and has entered a constraint state in which the dimensions thereof do not vary, the amount of shrinkage of the rubber spacer caused by a temperature change is larger than that of the rubber insulating tube.

Thereafter, the temperature of the rubber spacer also decreases with decreasing ambient temperature, loses rubber elasticity, and enters a constraint state in which the dimensions thereof do not vary. In the process of this temperature change, the rubber spacer is also hardened without being able to compensate for the shrinkage dimensions of the rubber spacer fully with the elasticity of the rubber spacer, the shrinkage dimensions observed when the rubber insulating tube entered a constraint state in which the dimensions thereof do not vary for the first time, and then enters a constraint state in which the dimensions thereof do not vary.

Here, common dimensions of the EP rubber insulating tube and the EP rubber spacer of the connecting member under study are, for example, as follows.

EP rubber spacer thickness: about 10 to 20 mm.

The fitting interface radius of the rubber insulating tube and the EP rubber spacer: 20 to 30 mm.

Since the rubber spacer is generally inserted at the time of assembly of the rubber insulating tube, compression strain on the rubber spacer caused by the rubber insulating tube in a fitted state is of the order of 5%.

Figure 4:
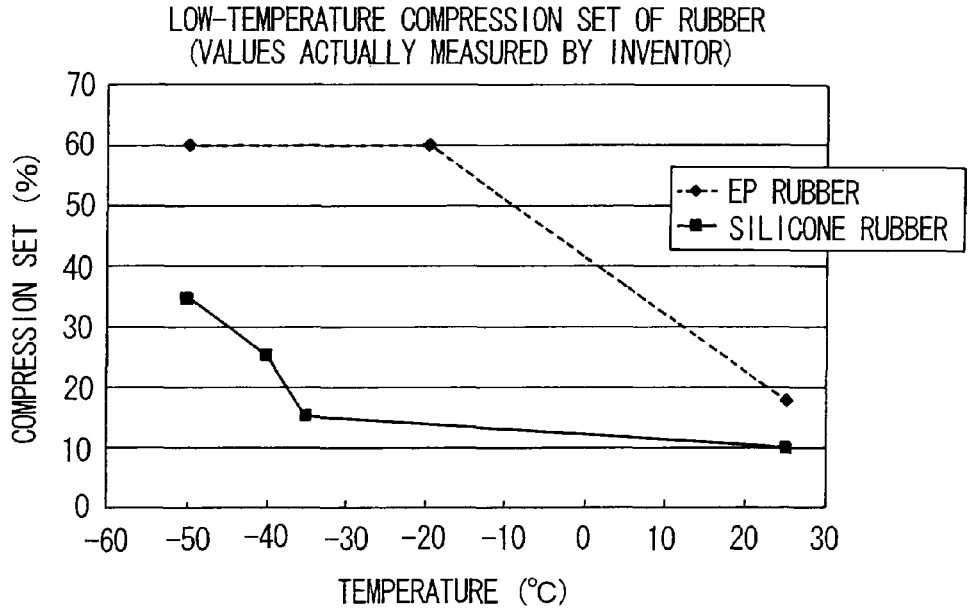
FIG. 4 is a graph for explaining a relationship between a test temperature and the compression set of EP rubber or silicone rubber.

As a result of the compression set of the rubber spacer in a temperature range of −20° C. or lower having reached 60% (FIG. 4), the compression strain decreases from 5% to about 2% corresponding to the remaining 40% of the compression set. As a result, the fitting interface radius of the rubber insulating tube and the EP rubber spacer at the time of assembly (at room temperature) and that of at the temperature range of −20° C. or lower is 20 mm×0.02=0.4 mm. When the temperature further decreases and the elongation modulus of the rubber spacer also becomes three or more times as high as that at room temperature, the rubber spacer loses elasticity, and enters a state in which it only makes contact with the rubber insulating tube at the fitting interface radius of the rubber insulating tube and the rubber spacer.

Here, when the temperature of the rubber insulating tube is −50° C. and the temperature of the rubber spacer is −30° C., interface shrinkage of the rubber spacer occurs due to a temperature difference. The interface shrinkage dimensions of the rubber spacer in that case are calculated as follows:

[the interface shrinkage dimensions of the rubber spacer]=$(2.51-1.40)\times10^{-4}$[/K]×20[deg]×(10 to 20)[mm](the fitting interface radius of the rubber insulating tube and the EP rubber spacer)=0.022 to 0.044[mm].

Therefore, the rubber spacer shrinks by 0.022 to 0.044 mm from the fitting interface radius described above, in which case it only makes contact with the rubber insulating tube as a result of it having stiffened due to a decrease in temperature. This results in the formation of a gap at the interface.

Namely, at room temperature the difference of the outer diameter of the rubber spacer and the inner diameter of the rubber insulating tube exhibits about 1 mm which is an insertion limit at room temperature and when the temperature decreases to a temperature range in which the elongation modulus EP rubber sharply increases from that at room temperature, there is a possibility that a gap is formed at the interface as a result of the EP rubber having become hard and as a result of temperature shrinkage having occurred.

In a temperature range that is lower than a temperature at which the elongation modulus of EP rubber is three or more times as high as that at room temperature, the clamping pressure becomes zero at the interface between the rubber insulating tube and the rubber spacer, a gap is formed at the interface, partial discharge occurs in a region of high electrical stress, and a dielectric breakdown eventually occurs due to discharge degradation.

<Regarding the Interface Between EP Rubber and Silicone Rubber>

A description will be given of the case where the rubber spacer is formed of silicone rubber and the temperature of the silicone rubber when the elongation modulus thereof increases three or more times as high as that at room temperature is −70° C.

Silicone rubber spacer thickness: about 10 to 20 mm.

The fitting interface radius of the rubber insulating tube and the EP rubber spacer: 20 to 30 mm.

Generally, the rubber spacer is compressed and inserted into the rubber insulating tube at the time of construction, and compression strain on the silicone rubber spacer caused by the rubber insulating tube in a fitted state is of the order of 100.

As a result of the compression set of the silicone rubber spacer at −30° C. or lower having reached 15 to 35% (FIG. 4), the compression strain of the rubber spacer at −30° C. or lower decreases from 10%, which is a value obtained at room temperature, to about 8.5 to 6.5% corresponding to the remaining 85 to 65% of the compression set. However, unlike the case of the EP rubber spacer, the silicone rubber spacer does not lose elasticity, and this compression strain of the order of 8.5 to 6.5% functions as a clamping radius difference (difference of the outer diameter of the rubber spacer clamped by the rubber insulating tube at the time of construction (at room temperature) and that of at −30° C. or lower).

Here, when the temperature of the rubber insulating tube is −50° C. and the temperature of the rubber spacer is −30° C., dimension shrinkage occurs due to a temperature difference.

On the other hand, the coefficient of linear expansion of silicone rubber is $3.4\times10^{-4}$/K at room temperature, $3.4\times10^{-4}$/K at −30° C., and $6.8\times10^{-4}$/K at −50° C., and increases sharply at −20° C. or lower.

For example, when the temperature of the rubber insulating tube is −50° C. and the temperature of the rubber spacer is −30° C., the interface shrinkage dimensions of the rubber spacer are calculated as follows:

$$[\text{The interface shrinkage dimensions of the rubber spacer}] = (6.8 - 1.4) \times 10^{-4}[/K] \times 20[\text{deg}] \times (20 \text{ to } 30)[\text{mm}] = 0.22 \text{ to } 0.33[\text{mm}].$$

At this point, the rubber spacer has high elasticity which is equal to that at room temperature, and can compensate for the interface shrinkage dimensions with the above-described clamping radius difference of the order of 8.5 to 6.5%. This allows these variations in dimensions to be compensated for without delay. Therefore, a gap is not formed at the interface between EP rubber and silicone rubber.

Even when the rubber insulating tube is hardened before the temperature of the rubber spacer becomes equal to the ambient temperature and enters a constraint state in which the dimensions thereof do not vary, the elasticity of the rubber spacer can accommodate variations in dimensions caused by transient shrinkage. In addition to this, when the temperature of the rubber spacer becomes equal to the ambient temperature, variations in dimensions caused by a temperature difference disappear. The elasticity of the rubber spacer helps maintain good insulating performance at the interface between the rubber insulating tube and the rubber spacer.

In a temperature range (a temperature range of −50° C. or lower) in which the elongation modulus silicone rubber is three or more times as high as that at room temperature, as is the case with the elongation modulus of EP rubber, the elongation modulus of silicone rubber shows a tendency to increase sharply. Therefore, at a temperature (approximately −50° C. or lower) at which the elongation modulus of the rubber insulating tube 10 increases three or more times as high as the elongation modulus at room temperature, when the elongation modulus of the rubber spacer 15 at such temperature is less than three times as high as the elongation modulus (approximately 2 MPa) at room temperature, good insulating performance at the interface between the rubber insulating tube and the rubber spacer is maintained. At this time, as shown in FIG. 2, a temperature (approximately −65° C.) (a first temperature) at which the elongation modulus of the rubber spacer 15 increases to a value (approximately 6 MPa) that is three or more times as high as the elongation modulus (approximately 2 MPa) of the rubber spacer 15 at room temperature is not less than 10° C. lower than a temperature (approximately −30° C.) (a second temperature) at which the elongation modulus of the rubber insulating tube 10 increases three or more times as high as the elongation modulus (approximately 6 MPa) of the rubber insulating tube 10 at room temperature (FIG. 2). As described above, since an increase in the elongation modulus of silicone rubber from that at room temperature to that at −50° C. is small, the silicone rubber does not show a tendency to become hard even when the environmental temperature is −50° C., and has rubber elasticity which is equal to that at room temperature. Therefore, until the temperature inside the rubber spacer decreases with decreasing temperature of the rubber insulating tube, a gap is not formed at the interface between the rubber insulating tube and the rubber spacer, and a dielectric breakdown does not occur. Moreover, since the EP rubber is used in the rubber insulating tube, and the silicone rubber is used only in the spacer, they are insusceptible to mechanical damage, and high insulating performance is maintained even in humid conditions such as when it is snowing or raining.

In addition, since the silicone rubber has high elasticity, it is possible to increase a fit diameter difference between the rubber spacer and the rubber insulating tube to about 3 mm. At this time, there is no possibility that the workability at the time of insertion of the rubber spacer into the rubber insulating tube is affected. This makes it possible to achieve high insulating performance in a low-temperature range with ease and reliability.

As described above, according to the present embodiment, since the rubber spacer 15 is inserted between the rubber insulating tube 10 and an end of the cable 20, it is possible to compensate for a fit diameter difference between the rubber insulating tube 10 and the cable easily even when several types of cables having different outside diameters are used. Moreover, when, at a temperature (approximately −30° C. or lower) at which the elongation modulus of the rubber insulating tube 10 increases three or more times as high as that at room temperature, the elongation modulus of the rubber spacer 15 at such temperature is less than three times as high as the elongation modulus (approximately 2 MPa) at room temperature, a gap is not formed between the rubber spacer 15 and the rubber insulating tube 10, and a dielectric breakdown does not occur. This makes it possible to maintain high insulating performance even in a low-temperature range from −30° C. down to −60° C. without decreasing mechanical strength of the rubber insulating tube 10.

Moreover, according to the present embodiment, it is possible to use a common rubber insulating tube for several types of cables having different outside diameters, and maintain high insulating performance with an inexpensive and simple structure because all that is needed is to fabricate only the rubber spacer 15 by using silicone rubber. In addition, since high insulating performance can be maintained only by inserting the rubber spacer 15 into the rubber insulating tube 10 at the time of construction, it is possible to improve the workability in assembly of the cable connecting member at the time of construction.

Furthermore, according to the present embodiment, since the rubber insulating tube 10 is formed of a composition containing EP rubber as a main ingredient, preferably a rubber composition containing, as a main ingredient, an ethylene propylene copolymer or a terpolymer containing a third component, and the rubber spacer 15 is formed of a composition containing silicone rubber as a main ingredient, it is possible to obtain the above-described effects reliably.

Incidentally, in this embodiment, the rubber spacer 15 is formed of a composition containing silicone rubber as a main ingredient; however, the composition is not limited to this specific composition. The rubber insulating tube and the rubber spacer may be formed of a composition containing any other material as a main ingredient as long as, at a temperature at which the elongation modulus of the rubber insulating tube increases three or more times as high as that at room temperature, the elongation modulus of the rubber spacer at such temperature is less than three times as high as that at room temperature.

Figure 5:
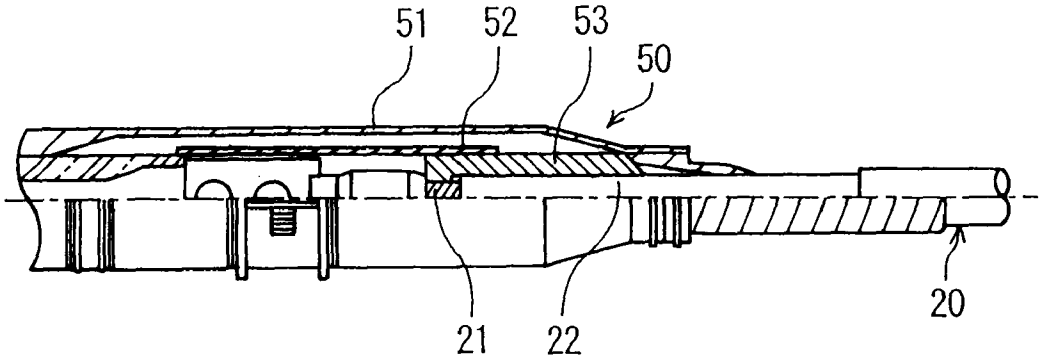
FIG. 5 is a diagram the showing a configuration of a variation of the cable connecting member for use in cold climates of FIG. 1.

FIG. 5 is a diagram showing the configuration of a variation of the cable connecting member 1 for use in cold climates of FIG. 1. A cable connecting member for use in cold climates shown in FIG. 5 is a cable connecting member which is directly connected to an apparatus and is I-shaped (hereinafter a "directly-connected (I-shaped) cable connecting member"), and, since the structure thereof is basically the same as that of the directly-connected (T-shaped) cable connecting member of FIG. 1, explanations of such components as find their counterparts in the directly-connected (T-shaped) cable connecting member of FIG. 1 will be omitted.

In FIG. 5, a cable connecting member 50 for use in cold climates includes a rubber insulating tube 51, an inner semiconducting layer 52 which is disposed in the rubber insulating tube 51 and houses an end of a rubber spacer, which will be described below, and a rubber spacer 53 which is inserted between the rubber insulating tube 51 and an end of a cable 20. In this directly-connected (I-shaped) cable connecting member, the outside diameter of the rubber spacer 53 is designed so as to be equal to or greater than the inside diameter of the rubber insulating tube 51. As a result, at the time of installation, the interface between the rubber spacer 53 and the rubber insulating tube 51 is held at a predetermined contact pressure by the rubber elasticity of any one of the rubber spacer 53 and the rubber insulating tube 51 or both, whereby insulating characteristics are ensured.

Figure 6:
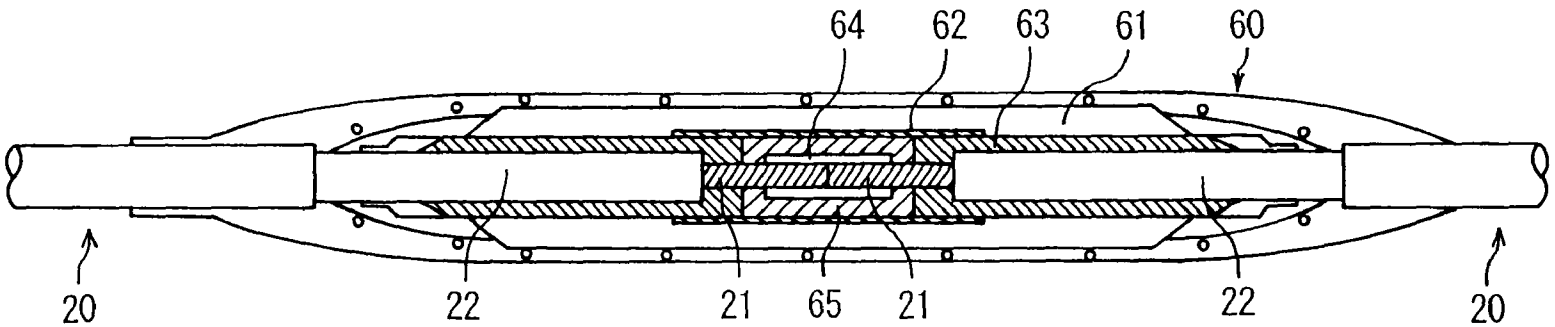
FIG. 6 is a diagram the showing a configuration of another variation of the cable connecting member for use in cold climates of FIG. 1.

FIG. 6 is a diagram showing the configuration of another variation of the cable connecting member 1 for use in cold climates of FIG. 1. A cable connecting member for use in cold climates shown in FIG. 6 is a straight cable connecting member used for connecting the ends of power cables together, and, since the structure thereof is basically the same as that of the directly-connected (T-shaped) cable connecting member of FIG. 1, explanations of such components as find their counterparts in the directly-connected (T-shaped) cable connecting member of FIG. 1 will be omitted.

As shown in FIG. 6, a cable connecting member 60 for use in cold climates includes a rubber insulating tube 61, an inner semiconducting layer 62 which is placed in the rubber insulating tube 61 and houses an end of a rubber spacer, which will be described below, and a rubber spacer 63 which is inserted between the rubber insulating tube 61 and a cable 20. Two cables 20 are inserted into both ends of the rubber spacer 63, and conductors of the two cables are connected to each other via a compression sleeve 64 placed in the center of the rubber spacer 63. Moreover, the cable connecting member 60 for use in cold climates includes a semiconducting rubber sleeve cover 65 which is fitted between two rubber spacers by insertion in the inner semiconducting layer 62 and houses the compression sleeve 64. In this straight cable connecting member, the outside diameter of the rubber spacer 63 is designed so as to be equal to or greater than the inside diameter of the rubber insulating tube 61. As a result, at the time of installation, the interface between the rubber spacer 63 and the rubber insulating tube 61 is held at a predetermined contact pressure by the rubber elasticity of any one of the rubber spacer 63 and the rubber insulating tube 61 or both, whereby insulating characteristics are ensured.

Figure 7:
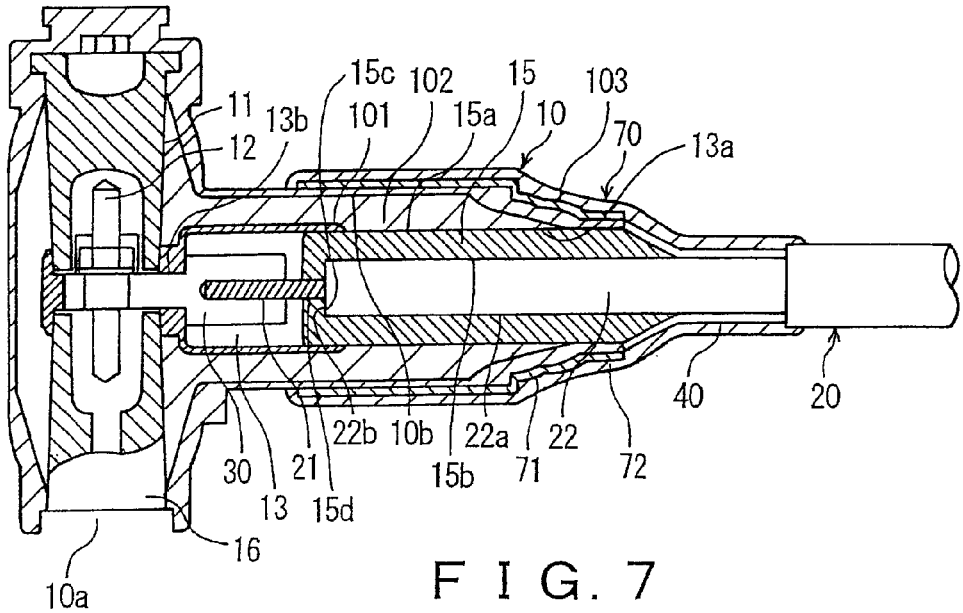
FIG. 7 is a sectional view of the showing a configuration of another variation of the cable connecting member for use in cold climates of FIG. 1.
Figure 8:
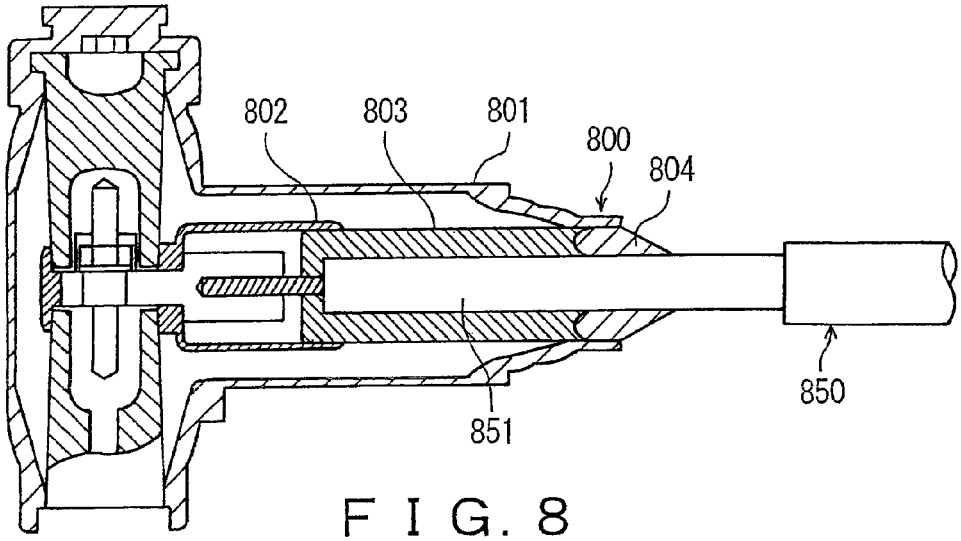
F I G. 8 (Background Art)
FIG. 8 is a sectional view schematically showing the configuration of a conventional cable connecting member which is directly connected to an apparatus and is T-shaped.
Figure 9:
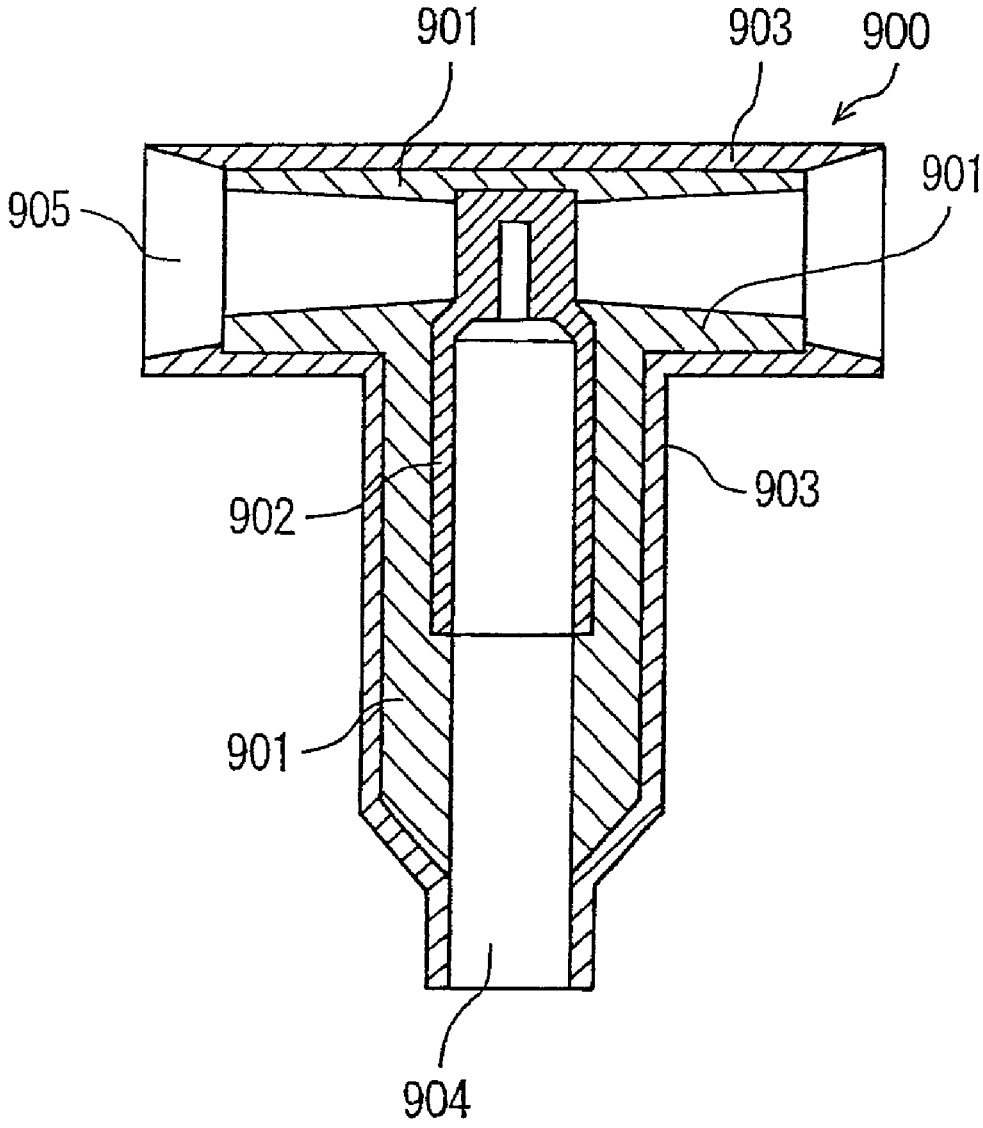
F I G. 9 (Background Art)
FIG. 9 is a sectional view schematically showing the configuration of another conventional cable connecting member which is directly connected to an apparatus and is T-shaped.

FIG. 7 is a sectional view showing the configuration of another variation of the cable connecting member 1 for use in cold climates of FIG. 1. Since the configuration of a cable connecting member for use in cold climates shown in FIG. 7 is basically the same as that of the directly-connected (T-shaped) cable connecting member of FIG. 1, explanations of such components as find their counterparts in the directly-connected (T-shaped) cable connecting member of FIG. 1 will be omitted.

In the sectional view, a vulcanized rubber tape 71 is wrapped around an outer peripheral surface of a rubber insulating tube 10 from a spacer housing-side end of the rubber insulating tube 10 to a position in which it overlaps an inner semiconducting layer 101. The vulcanized rubber tape 71 does not have an adhesive layer, and is fixed with one or two turns thereof wrapped around the rubber insulating tube 10. The vulcanized rubber tape 71 is formed of a material whose elongation modulus at room temperature is higher than the elongation modulus of the rubber insulating tube 10 at room temperature. Moreover, at a temperature at which the elongation modulus of the rubber insulating tube 10 increases three or more times as high as the elongation modulus of the rubber insulating tube 10 at room temperature, the elongation modulus of the vulcanized rubber tape 71 at such temperature is less than three times as high as the elongation modulus of the vulcanized rubber tape 71 at room temperature.

As the material of the vulcanized rubber tape 71, chloroprene rubber, EP rubber, or the like, can be used; however, the material is not limited thereto.

In the sectional view, a protective tape 72 is wrapped around a part from an end of the cable 20 to an end of the vulcanized rubber tape 71. The protective tape 72 has a bonding layer at one surface thereof, and is fixed with the vulcanized rubber tape 71 completely covered therewith. The protective tape 72 is formed of a material containing vinyl chloride as a main ingredient; however, the material is not limited thereto.

According to this variation, at a temperature at which the elongation modulus of the rubber insulating tube 10 increases three or more times as high as the elongation modulus of the rubber insulating tube 10 at room temperature, the elongation modulus of the vulcanized rubber tape 71 at such temperature is less than three times as high as the elongation modulus of the vulcanized rubber tape 71 at room temperature. Since silicone rubber has low mechanical strength compared with ethylene propylene rubber, it is possible to protect the silicone rubber effectively and provide improved prevention of water absorption. In addition, since the vulcanized rubber tape 71 provides a high mechanical protective function even at low temperature, together with the low-temperature flexibility of the rubber spacer 15, it is possible to maintain high low-temperature electrical characteristics of the cable connecting member.

Incidentally, in this modified example, the protective tape 72 has a bonding layer. However, the layer is not limited to this specific layer, and the protective tape 72 may have an adhesive layer.

Moreover, in this variation, the cable connecting member 70 for use in cold climates includes the vulcanized rubber tape 71 wrapped around the spacer housing-side surface of the rubber insulating tube 10. However, the invention is not limitative, but may be so implemented that the cable connecting member 70 for use in cold climates includes a vulcanized rubber layer formed on the spacer housing-side surface of the rubber insulating tube 10. Furthermore, the cable connecting member 70 for use in cold climates includes the protective tape 72 wrapped on the vulcanized rubber tape 71. However, the invention is not limitative, but may be so implemented that the cable connecting member 70 for use in cold climates includes a protective layer formed on the vulcanized rubber tape 71.

Example

Hereinafter, an example of the invention will be explained. The inventor studied the insulating characteristics of a cable connecting member under a low-temperature environment.

First, a rubber insulating tube and a rubber spacer were fabricated by using a composition containing EP rubber as a main ingredient and a composition containing silicone rubber as a main ingredient, respectively, and a cable connecting member shown in FIG. 7 was fabricated by using the EP rubber insulating tube and the silicone rubber spacer thus fabricated. Then, the insulating characteristics of the cable connecting member were evaluated by changing the environmental temperature from 20° C. down to −50° C. in test types I to IV shown in Table 1. The evaluation results are shown in Table 2.

TABLE 1

Low-temperature characteristic test conditions (sample number: test sequence A n = 1, test sequence B n = 2)

| Test types | Test sequence | Test conditions | Details |
|---|---|---|---|
| I. Presence or absence of partial discharge | A: I<br>B: II | Test equipment<br>Test temperature<br>Test voltage<br>Shape of sample | Large ultra-low temperature cryostat<br>−50° C.<br>30 kV, 10 pC or lower<br>Length of a cable including a terminal for application of voltage: 5 m<br>A part including a cable which is 0.5 m or longer in length from an end of a T-shaped cable connecting member is housed in the cryostat. |
| II. Commercial frequency withstand voltage test | A: I⇒ II | Test equipment<br>Test temperature<br>Test voltage<br>Shape of sample | Large ultra-low temperature cryostat<br>−50° C.<br>81 kV/5 minutes<br>Length of a cable including a terminal for application of voltage: 5 m<br>A part including a cable which is 0.5 m or longer in length from an end of a T-shaped cable connecting member is housed in the cryostat. |
| III. Temperature cycling test | B: I⇒ III | Test equipment<br>Test temperature<br>Test cycle number<br>Shape of sample | Large ultra-low temperature cryostat<br>1 cycle: 12 hours<br>Temperature is kept at 20° C. for 5 hours⇒ lowered for 1 hour⇒ kept at −40° C. for 5.5 hours⇒ raised for 0.5 hour.<br>Test cycle number: 30 cycles<br>Length of a cable including a terminal for application of voltage: 5 m<br>A part including a cable which is 0.5 m or longer in length from an end of a T-shaped cable connecting member is housed in the cryostat. |
| IV. Presence or absence of partial discharge after temperature cycling test | B: I⇒ II⇒ IV | Test equipment<br>Test temperature<br>Test voltage<br>Shape of sample | Large ultra-low temperature cryostat<br>−50° C.<br>30 kV, 10 pC or lower<br>Length of a cable including a terminal for application of voltage: 5 m<br>A part including a cable which is 0.5 m or longer in length from an end of a T-shaped cable connecting member is housed in the cryostat. |

TABLE 1-continued

Low-temperature characteristic test conditions (sample number: test sequence A n = 1, test sequence B n = 2)

| Test types | Test sequence | Test conditions | Details |
|---|---|---|---|
| | | | is housed in the cryostat. |

TABLE 2

Electrical characteristic test results

| Test types | Test voltage (specified value) | Test results A | Test results B (1) | Test results B (2) |
|---|---|---|---|---|
| I. Presence or absence of partial discharge | 30 kV<br>10 pC or lower | Absent (Acceptance) | Absent (Acceptance) | Absent (Acceptance) |
| II. Commercial frequency withstand voltage test | 81 kV/5 minutes | (Acceptance) | | |
| IV. Presence or absence of partial discharge after temperature cycling test | 30 kV<br>10 pC or lower | | Absent (Acceptance) | Absent (Acceptance) |

This example revealed that fabricating an insulating tube and a spacer by using a composition containing EP rubber as a main ingredient and a composition containing silicone rubber as a main ingredient, respectively, makes it possible to apply a common insulating tube to several types of cables having different outside diameters, and maintain high insulating performance without decreasing mechanical strength even in cold climates where the environmental temperature is low.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2009-43421, filed Feb. 26, 2009, which is hereby incorporated by reference herein in its entirety.

What is claimed is:

1. A cable connecting member for use in cold climates, comprising:

a rubber insulating tube housing an end of a cable and enhancing electrical insulation from the cable; and a rubber spacer inserted between said rubber insulating tube and the end of the cable, wherein said rubber spacer has an outer peripheral surface making contact with an inner peripheral surface of a spacer holder provided in said rubber insulating tube, the spacer holder into which said rubber spacer is inserted, and an outside diameter of said rubber spacer is equal to or greater than an inside diameter of the spacer holder, wherein the inside diameter of said rubber spacer is designed so as to be equal to or smaller than the outside diameter of the outer peripheral surface of an insulation layer of the cable, wherein when the cable to which said rubber spacer is attached is inserted into said rubber insulating tube, an outer peripheral surface of said rubber spacer is brought into contact with an inner peripheral surface of said rubber insulating tube by pressure by a rubber elasticity of said rubber insulating tube and/or said rubber spacer, and said rubber spacer is housed in said rubber insulating tube, wherein said rubber insulating tube, being molded of rubber, is formed of a composition containing ethylene propylene rubber as a main ingredient, and said rubber spacer is formed of a composition containing silicone rubber as a main ingredient, and wherein at a temperature at which an elongation modulus of said rubber insulating tube increases three or more times as high as the elongation modulus of said rubber insulating tube at room temperature, an elongation modulus of said rubber spacer at such temperature is less than three times as high as the elongation modulus of said rubber spacer at room temperature.

2. A cable connecting member for use in cold climates as claimed in claim 1, further comprising:

a vulcanized rubber layer formed on a spacer housing-side surface of said rubber insulating tube; and a protective layer formed on said vulcanized rubber layer, wherein at a temperature at which an elongation modulus of said rubber insulating tube increases three or more times as high as the elongation modulus of said rubber insulating tube at room temperature, an elongation modulus of said vulcanized rubber layer at such temperature is less than three times as high as the elongation modulus of the vulcanized rubber layer at room temperature.

3. A cable connecting member for use in cold climates as claimed in claim 1, wherein said rubber insulating tube is formed of a rubber composition which is an ethylene propylene copolymer or a terpolymer containing a third component.

4. A cable connecting member for use in cold climates as claimed in claim 1, wherein said rubber insulating tube has an inner semiconducting layer formed on an inner peripheral surface of a spacer holder into which the rubber spacer is housed, and the inner semiconducting layer makes contact with an outer peripheral surface of the rubber spacer.

5. A cable connecting member for use in cold climates as claimed in claim 1, wherein the rubber spacer has an innermost surface making contact with an end face of an insulation layer of the cable, and the innermost surface has a hole for a conductor, through which the conductor of the cable is inserted.

6. A cable connecting member for use in cold climates as claimed in claim 1, wherein the cable connecting member for use in cold climates is a connecting member which is directly connected to an apparatus, the connecting member for connecting an end of a cable to the apparatus.

7. A cable connecting member for use in cold climates as claimed in claim 1, wherein the cable connecting member for use in cold climates is a straight connecting member for connecting ends of cables together.

* * * * *